US008297166B2

(12) United States Patent
Onuk

(10) Patent No.: US 8,297,166 B2
(45) Date of Patent: Oct. 30, 2012

(54) FOLDABLE RAMP FOR MISSILE LAUNCHERS

(75) Inventor: Ekber I. N. Onuk, Istanbul (TR)

(73) Assignee: Onuk Tasit Sanayi Limited Sirketi, Istanbul (TR)

( * ) Notice: Subject to any disclaimer, the term of this patent is extended or adjusted under 35 U.S.C. 154(b) by 212 days.

(21) Appl. No.: 11/979,485

(22) Filed: Nov. 5, 2007

(65) Prior Publication Data

US 2010/0282150 A1 Nov. 11, 2010

(30) Foreign Application Priority Data

Oct. 23, 2007 (EP) ..... 07119060

(51) Int. Cl.
*F41A 11/04* (2006.01)

(52) U.S. Cl. ..... 89/1.804

(58) Field of Classification Search ..... 89/1.804, 89/1.802, 1.81, 1.816, 1.8, 1.806, 1.815, 89/41.18, 41.16; 248/133, 132, 136, 150, 248/149, 371, 398, 652, 654; 211/169, 169.1
See application file for complete search history.

(56) References Cited

U.S. PATENT DOCUMENTS

| | | | | | |
|---|---|---|---|---|---|
| 2,450,929 | A | * | 10/1948 | Ashworth et al. | 89/1.804 |
| 2,867,153 | A | * | 1/1959 | Hirsch | 89/1.806 |
| 2,949,823 | A | * | 8/1960 | Ross et al. | 89/1.815 |
| 3,106,132 | A | * | 10/1963 | Biermann et al. | 89/1.815 |
| 3,217,900 | A | * | 11/1965 | Kupetzky et al. | 414/742 |
| 3,303,740 | A | * | 2/1967 | Grayson et al. | 89/1.815 |
| 3,379,097 | A | * | 4/1968 | Fisher | 89/1.816 |
| 3,406,606 | A | * | 10/1968 | Schoffl | 89/1.815 |
| 3,742,814 | A | * | 7/1973 | Kroh | 89/1.8 |
| 3,832,932 | A | * | 9/1974 | Even et al. | 89/40.11 |
| 4,141,277 | A | * | 2/1979 | Bouillon | 89/38 |
| 4,305,325 | A | * | 12/1981 | Lange et al. | 89/1.815 |
| 4,326,446 | A | | 4/1982 | Magnuson | |
| 4,848,732 | A | * | 7/1989 | Rossato | 254/90 |
| 6,584,881 | B1 | * | 7/2003 | Boudreau et al. | 89/1.804 |
| 6,691,600 | B2 | * | 2/2004 | Boudreau et al. | 89/1.815 |
| 6,742,433 | B2 | * | 6/2004 | Smith et al. | 89/1.815 |
| 7,313,995 | B2 | * | 1/2008 | Shah et al. | 89/1.815 |
| 7,351,448 | B1 | * | 4/2008 | Irvin et al. | 427/162 |
| 2006/0086241 | A1 | * | 4/2006 | Miller et al. | 89/1.802 |

FOREIGN PATENT DOCUMENTS

| | | | |
|---|---|---|---|
| FR | 2 688 466 | A1 | 9/1993 |
| WO | WO 2005/033611 | A1 | 4/2005 |

* cited by examiner

*Primary Examiner* — Michael Carone
*Assistant Examiner* — Reginald Tillman, Jr.
(74) *Attorney, Agent, or Firm* — Arent Fox LLP

(57) ABSTRACT

The foldable ramp is intended to store, carry and launch relatively large size tube-launched missiles typically on board of relatively small sized naval surface ships. Accordingly, the foldable ramp comprises a frame suitable for carrying one or more canisters for launching rockets or missiles and support elements, which are pivotably attached to the frame and which are adapted to pivotably connect to the launching platform so as to allow rotary movement of the frame with respect to the launching platform. A lifting device lifts the front end of the frame whereby the rear end of the canisters displace a horizontal distance towards the rear of the ramp as said lifting device lifts the frame. Adverse effects of the aft flame of the launched rocket or missile is securely displaced to the outside of the vehicle while foldability of the ramp enables to prevent or reduce radar and eye visibility of the launcher, particularly when mounted on a naval surface ship.

10 Claims, 8 Drawing Sheets

FOLDABLE RAMP FOR MISSILE LAUNCHERS

TECHNICAL FIELD OF THE INVENTION

Figure 1:
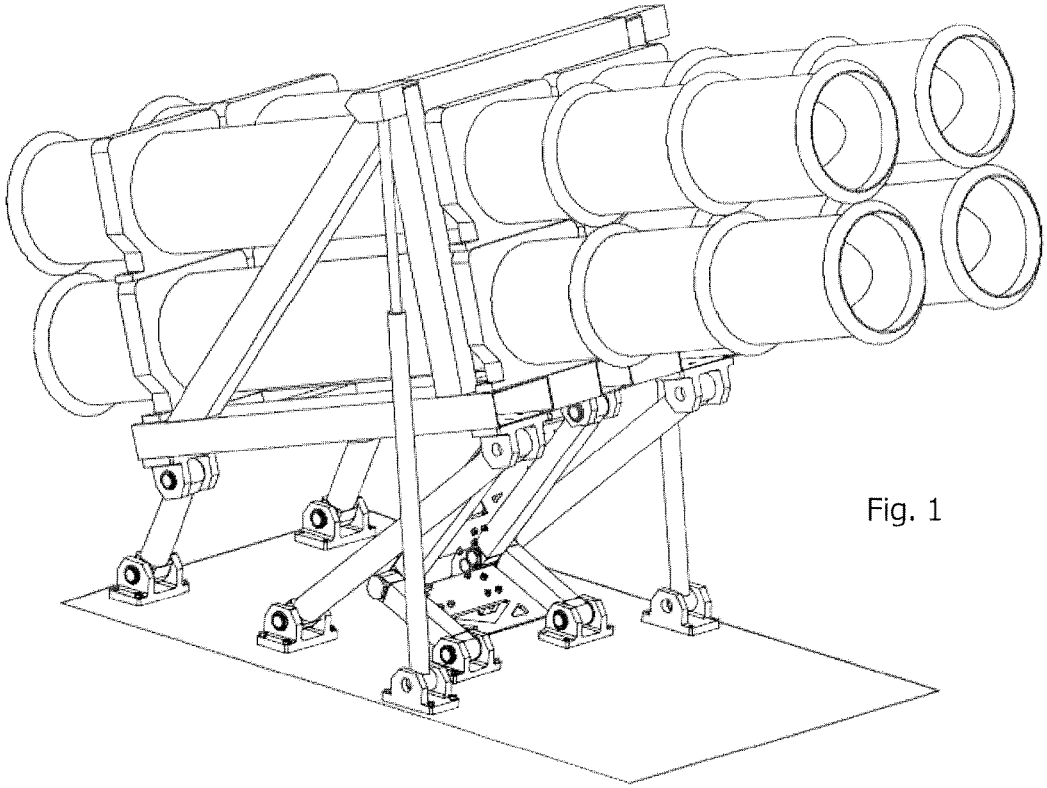

The present invention relates to a foldable ramp for missile launchers, particularly for use on relatively small sized military purpose surface ships. The foldable ramp as proposed by the present invention is particularly suitable for launching self propelled SAM type (surface-to-air) or SSM type (surface-to-surface) guided missiles from frigates.

DESCRIPTION OF THE PRIOR ART

Guided missiles are self propelled and guided internally or externally from a remote location such as a satellite or the launching station once the missile is fired from its ramp. The ramp is usually in the form of a plurality of canisters that are used to carry, orientate and launch the missiles towards the desired direction. Ramps for guided missiles are typically rotated at least roughly to a certain extent towards the target and pivoted at their rear ends so as to allow elevation, as necessary, of the missile tip. Since the missiles can be guided as required, it is not necessary to precisely orientate a ramp towards the target. Nevertheless, this is not always the case e.g. for unguided rocket launchers. One such device is disclosed in GB 1 150 894 in which the front end of the ramp is elevated by means of a servo motor whereas the back end of the ramp is pivotably connected to a launching platform. A major drawback of this type of a ramp is the damage to the platform due to high heat release from nozzle of the drive source of the rocket or missile during launching. The aft flame of the launched device is not only harmful for the surface of launching platform but also hazardous for any personnel that might be in the vicinity of the platform.

When a guided missile is to be launched from a naval surface ship, the aft flame of the missile becomes detrimental for the deck of the ship. In most cases, the deck of the ship is protected from damage originating from the high heat release of the aft flame through use of heat endurable layers such as ceramics on parts of the deck. This requires special processing on the surface of the deck and adds cost when installing launchers on ships. Still, the aft flame of the missile is hazardous for personnel in the proximity of the launcher platform on the deck. Moreover, there is no need to mention the lifetime cycles or costs of maintenance of heat endurable coatings or layers onboard.

Damage to the deck originating from the high heat release of aft flame of a missile have been avoided by building tall ramps that orientate the canisters at a considerable height over the deck such that contact of the aft flame to the deck is reduced. While taller constructions help reduce the flame damage, they are generally very heavy which makes them impractical for use on frigates or relatively small sized surface ships, typically less than 50 m long. Another problem associated with these conventional ramps is their enormous radar visibility, which makes them suitable for use only on large size destroyers. While high speed frigates can be made to have a considerably low radar cross section, there is no effective solution that would allow them carry a relatively large launcher on board without jeopardizing their radar invisibility.

Typically, missile launchers of the prior art are stationarily mounted on the deck of a naval ship which makes them still visible to outsiders. As conventional launchers have limited freedom of movement, where typically the canisters may only be rotated and pitched, their visibility on the deck still poses a potential risk even during piece time. As is well known, small sized frigates are usually used for border patrolling purposes under piece conditions. While visibility of missile launchers on board of a patrolling frigate may be scary or at least undesired for a friendly civilian, it is on the other hand fairly informative for the unfriendly ones in terms of the amount and type of the armament carried on the frigate. Hence, conventional launchers not only have the drawback of unfavorable radar cross section, but also the drawback of eye visibility.

SUMMARY OF THE INVENTION

The foldable ramp is intended to store, carry and launch relatively large size tube-launched missiles typically on board of relatively small sized naval surface ships. Accordingly, the foldable ramp according to the present invention comprises a frame suitable for carrying one or more canisters for launching rockets or missiles. The foldable ramp further comprises at least one rear support element and at least one front support elements, which are pivotably attached to the frame and which are adapted to pivotably connect to the launching platform so as to allow rotary movement of the frame with respect to the launching platform. A lifting device lifts the front end of the frame whereby the rear end of the canisters displace a horizontal distance towards the rear of the ramp as said lifting device lifts the front end of said frame. Adverse effects of the aft flame of the launched rocket or missile is therefore securely displaced to the outside of the vehicle to which the foldable ramp of the present invention is installed. Furthermore, the foldability of the ramp along with the side features enables to prevent or at least to reduce radar and eye visibility of the launcher, particularly when mounted on a naval surface ship.

OBJECTS OF THE PRESENT INVENTION

Primary object of the present invention is to provide foldable ramp for launching guided missiles from a relatively small sized naval surface ship, such as a frigate, said missile ramp eliminating the drawbacks outlined in the background of the invention.

A further object of the invention is to provide ramp for launching rockets or guided missiles from a naval surface ship, said ramp preventing damage to the surface of deck as well as its surrounding on the launching platform due to heat release from the aft flame of launched weapon.

A further object of the invention is to provide ramp for launching rockets or guided missiles from a naval surface ship, said ramp being foldable such that its radar cross section is reduced when folded.

Still a further object of the invention is to provide ramp for launching rockets or guided missiles from a naval surface ship, said ramp being covered by a collapsible case when folded such that eye visibility of the weapon system is prevented under normal conditions.

Yet another object of the invention is to provide ramp for launching rockets or guided missiles from a naval surface ship, said ramp being adapted and located on board of the ship so as not to jeopardize the dynamic stability of the ship during cruise.

Other objects of the present invention will become apparent from accompanied drawings, brief descriptions of which follow in the next section as well as appended claims.

BRIEF DESCRIPTIONS OF THE DRAWINGS

Figure 2:
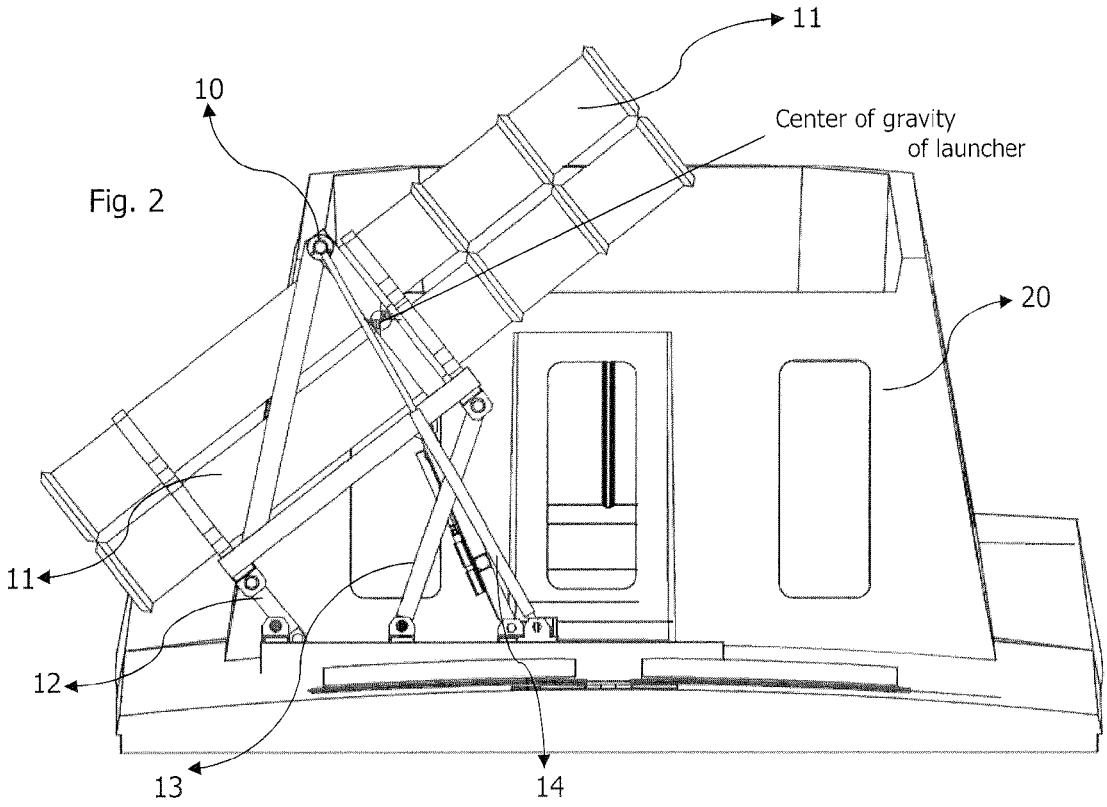
Figures 3A, 3B, 3C:
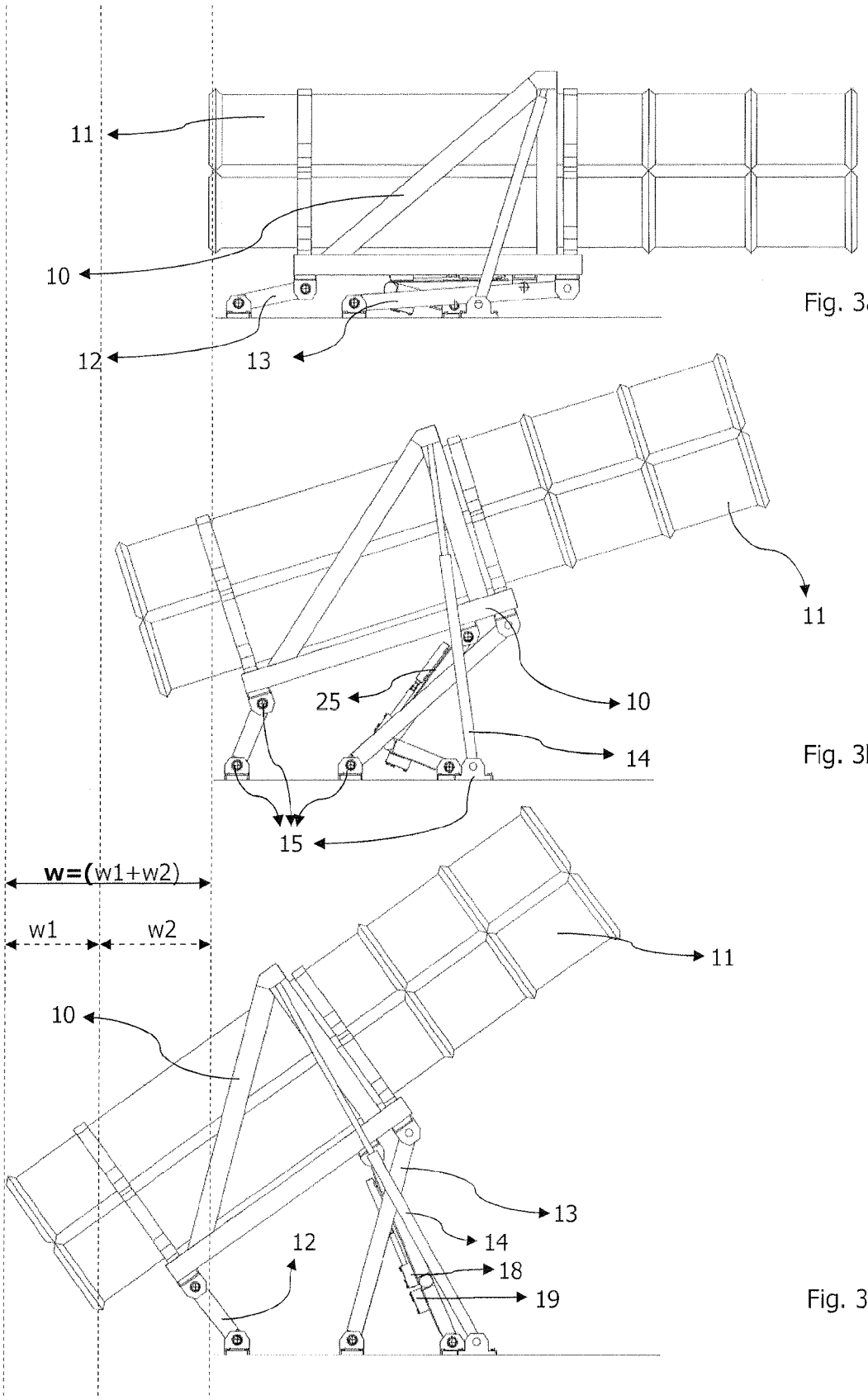
Figure 4A:
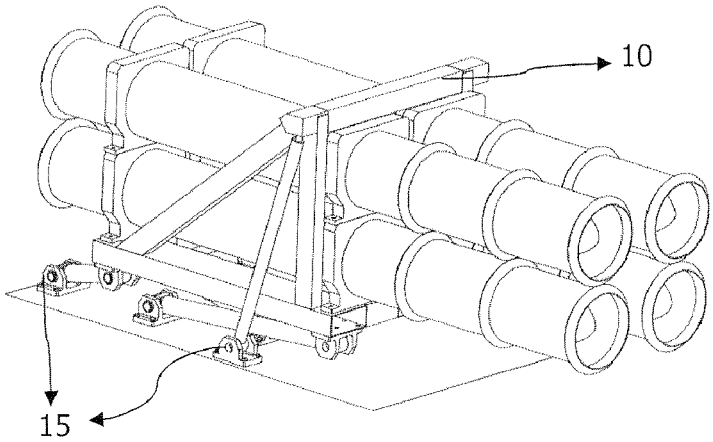
Figure 4B:
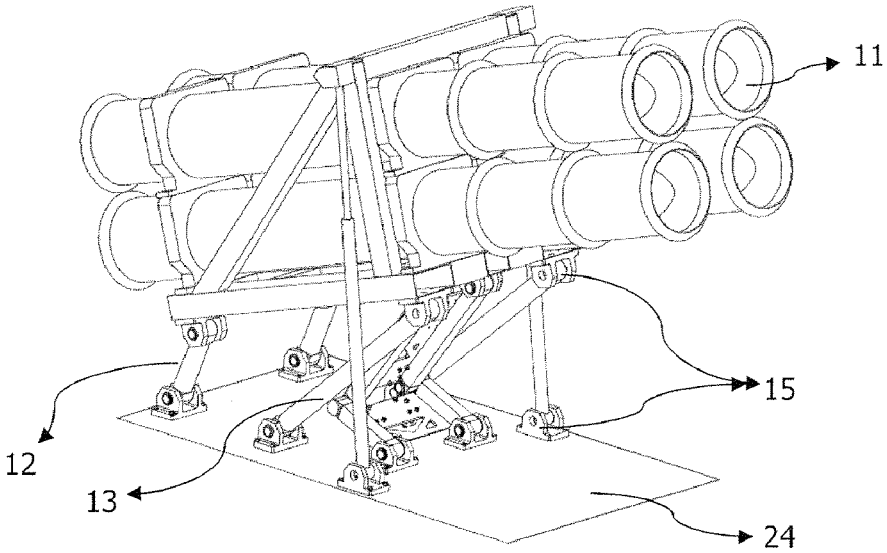
Figure 4C:
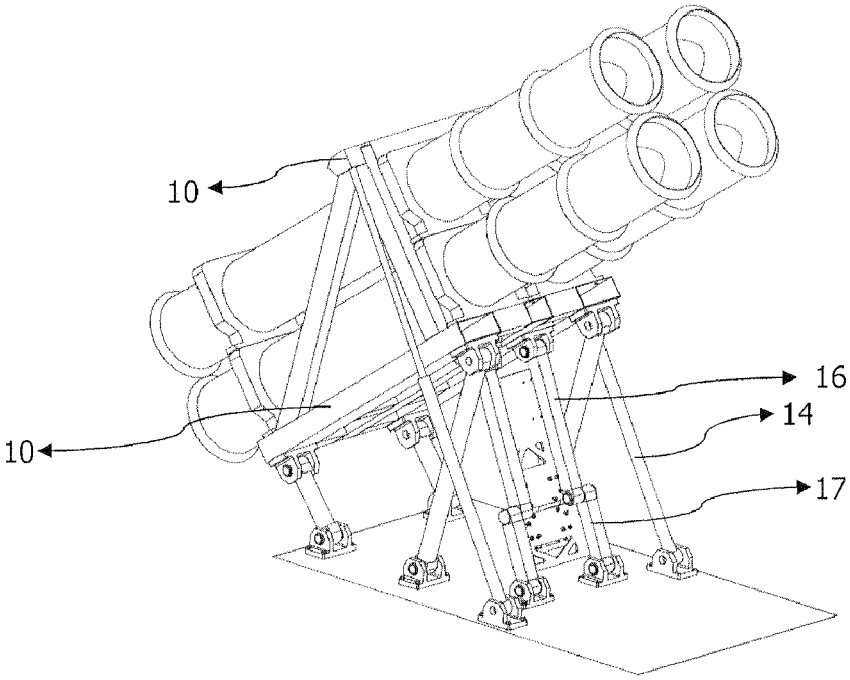
Figure 5A:
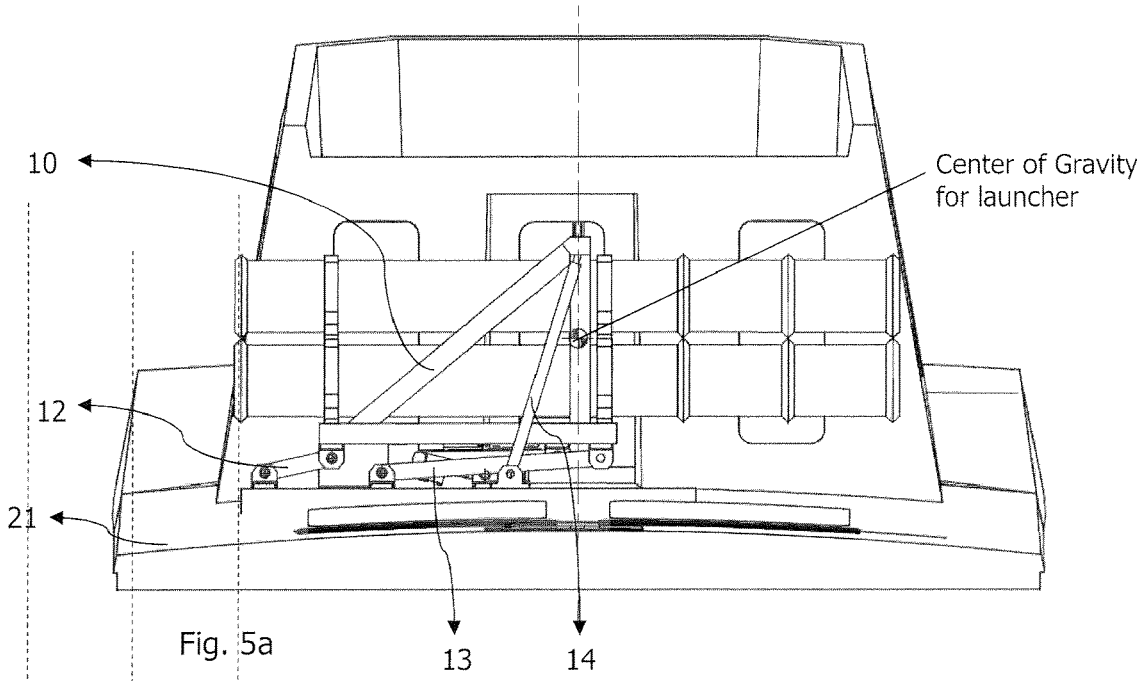
Figure 5B:
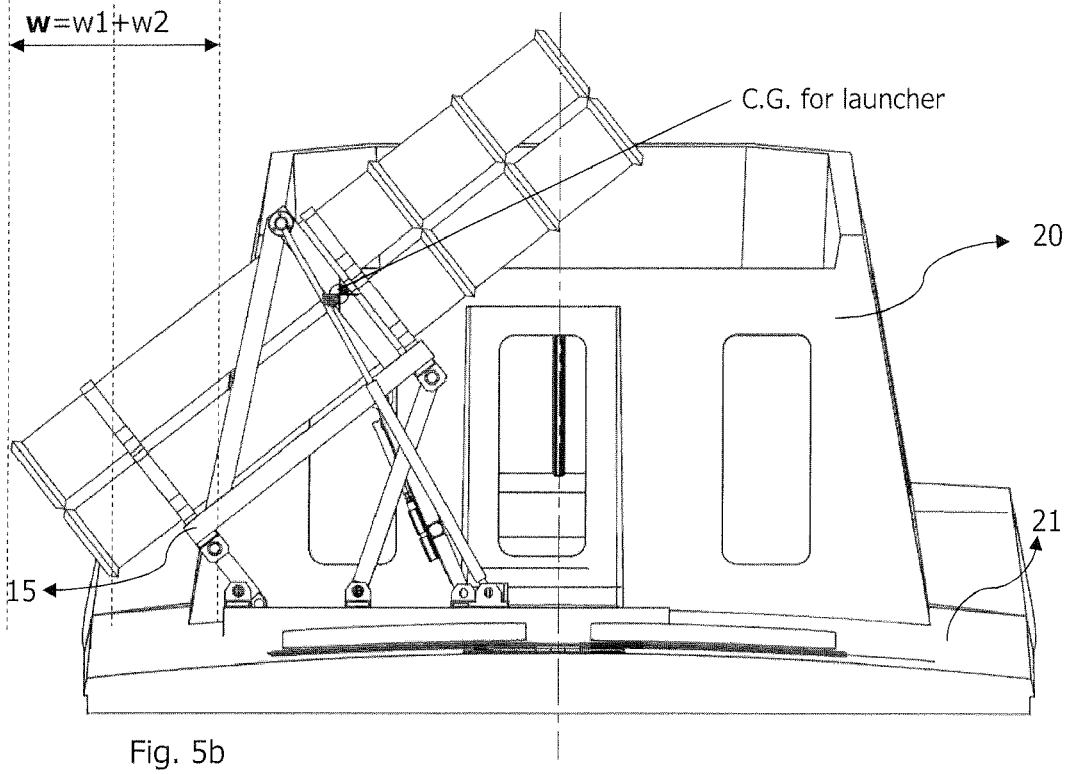
Figure 6A:
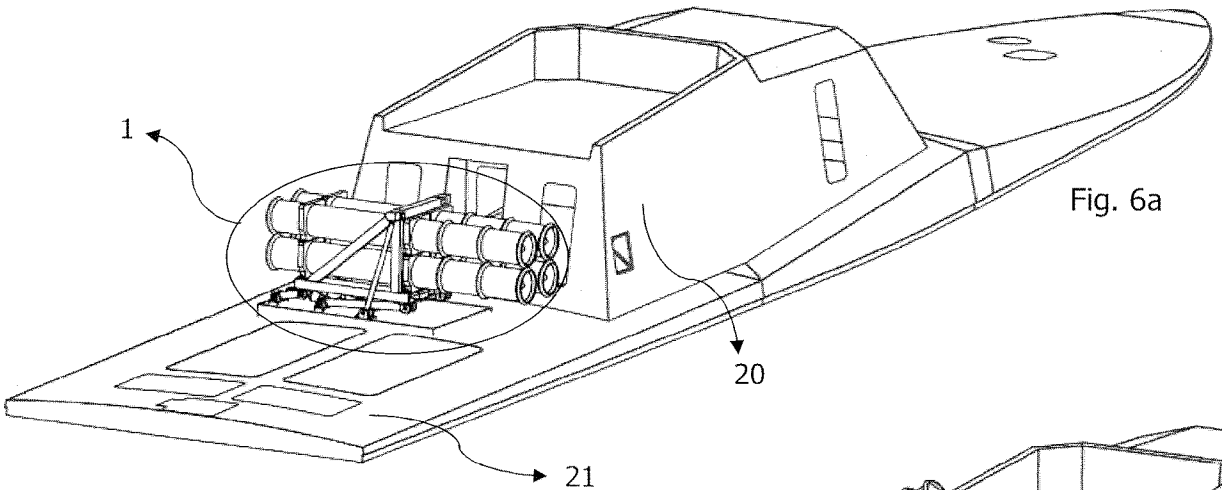
Figure 6B:
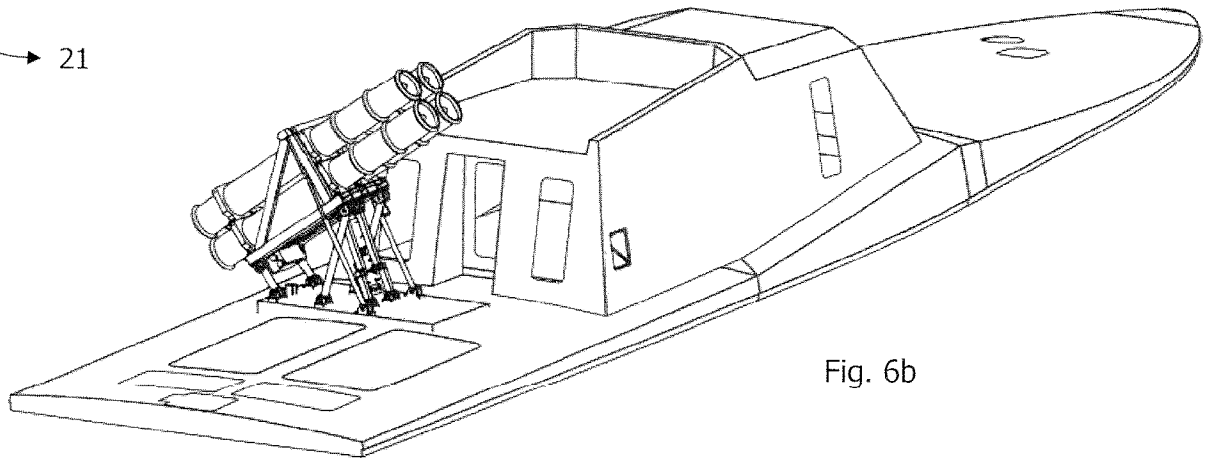
Figure 8:
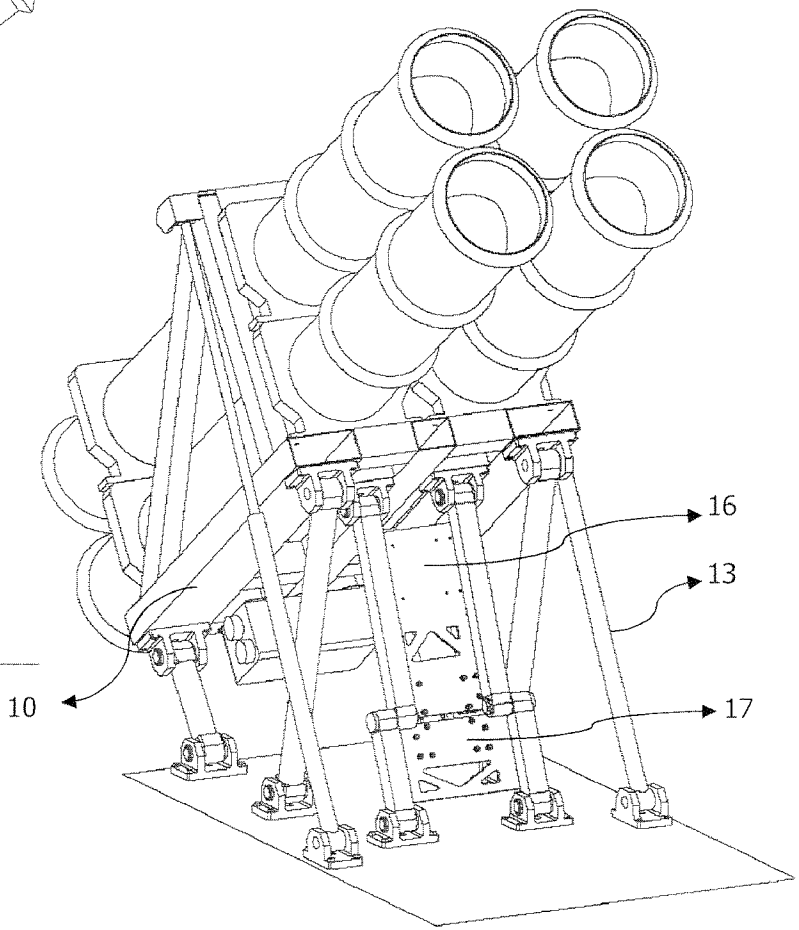
Figure 7:
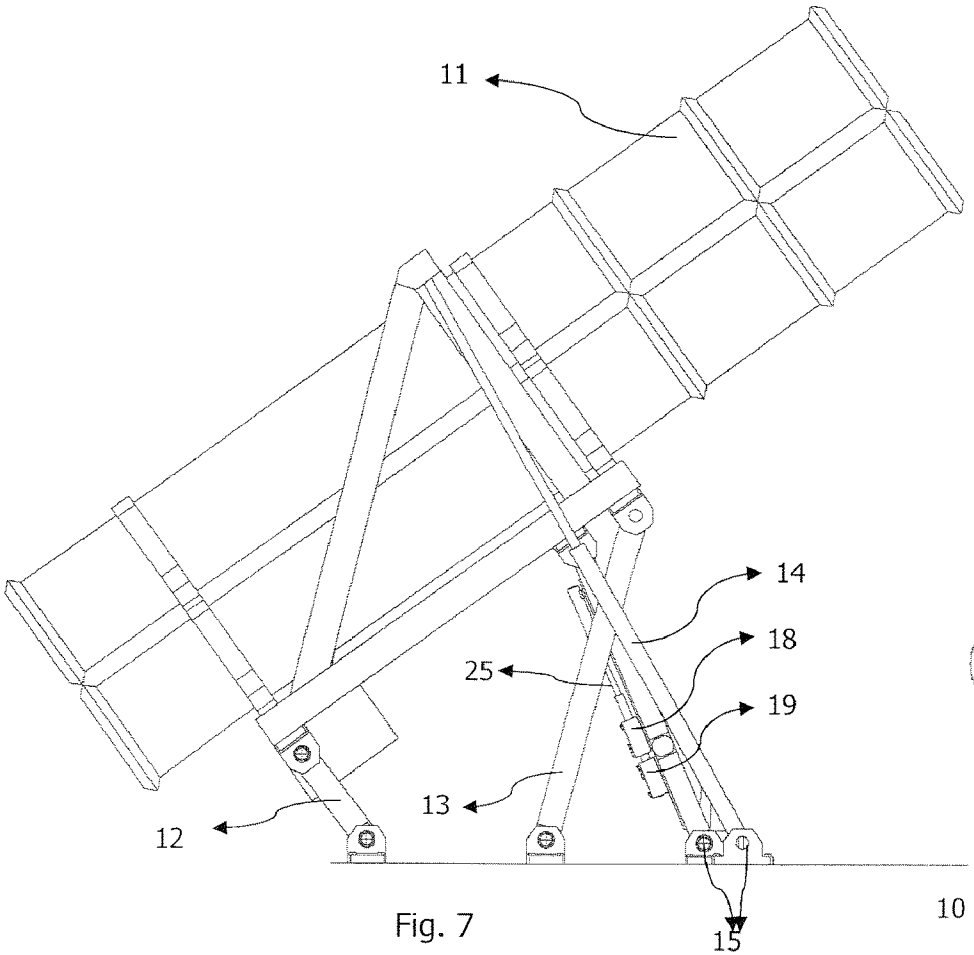
Figure 9A:
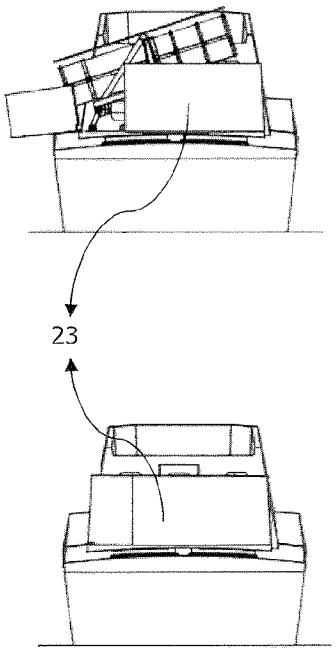
Figure 9A:
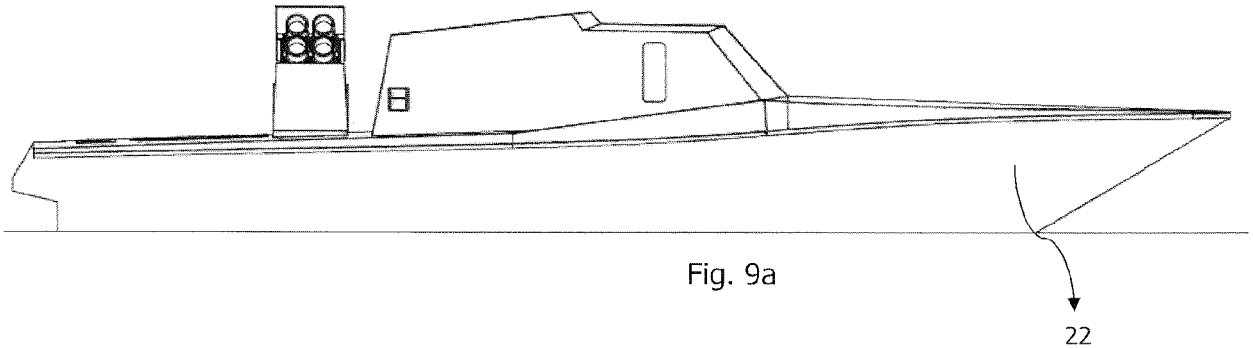
Figure 9B:
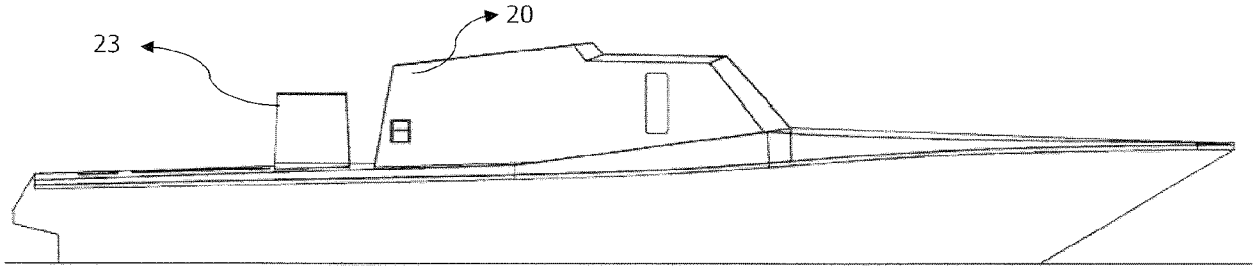
Figures 10A, 10B:
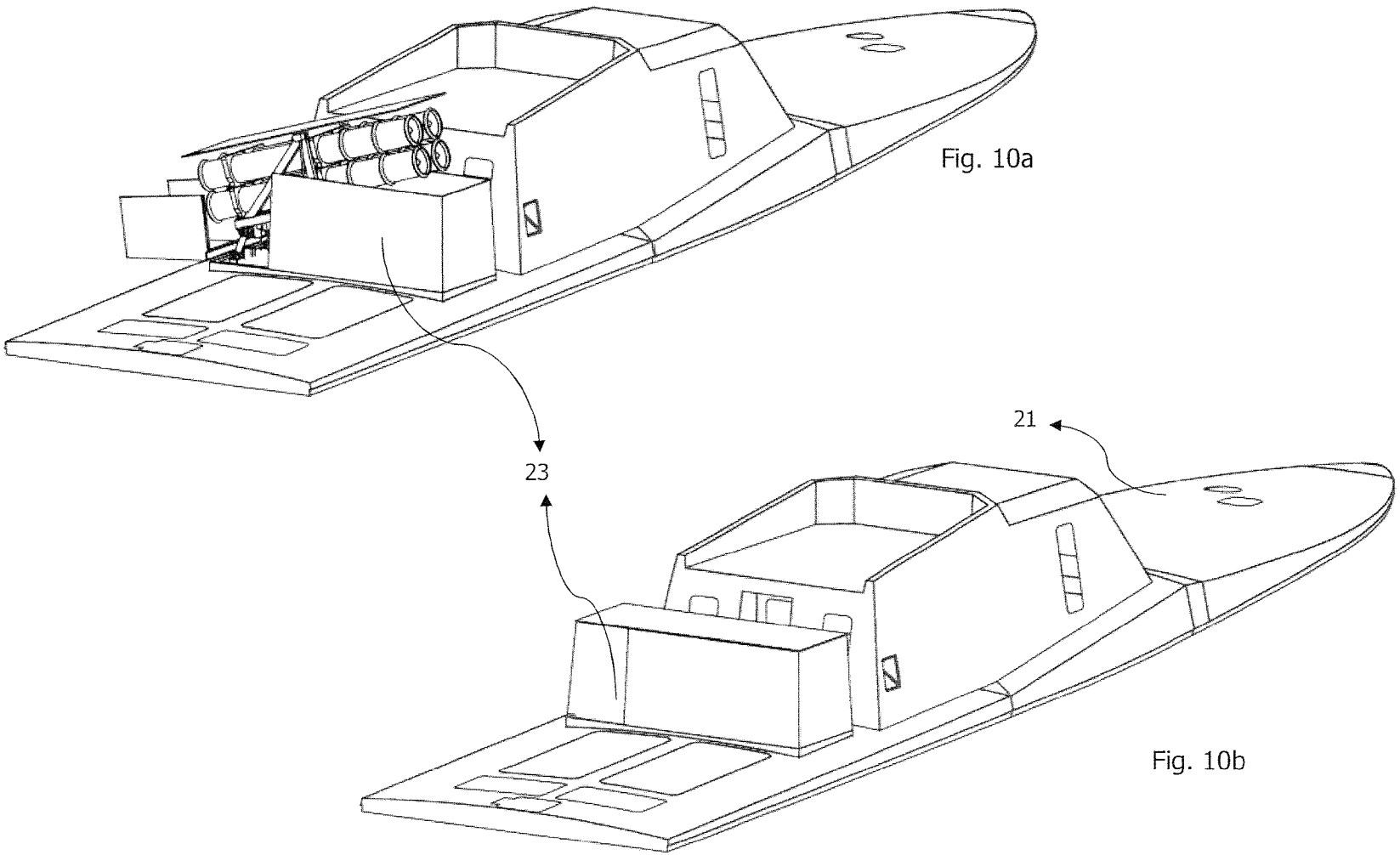

FIG. 1 shows a perspective view of the ramp according to the present invention in a semi-open position, FIG. 2 shows 2-D view of the ramp in a fully erected position behind the steering cabin of a naval surface ship, FIG. 3*a* shows side view of the ramp according to the present invention in the closed (folded) position, FIG. 3*b* shows side view of the ramp according to the present invention in the semi-open position, FIG. 3*c* shows side view of the ramp according to the present invention in the open (unfolded) position, FIG. 4*a* shows a perspective view of the ramp according to the present invention in the closed (folded) position, FIG. 4*b* shows a perspective view of the ramp according to the present invention in the semi-open position, FIG. 4*c* shows a perspective view of the ramp according to the present invention in the open (unfolded) position, FIG. 5*a* shows 2-D view of the ramp in folded position behind the steering cabin of a naval surface ship, FIG. 5*b* shows 2-D view of the ramp in a fully erected position behind the steering cabin of a naval surface ship, FIG. 6*a* shows a perspective view of the ramp in folded (closed) position behind the steering cabin of a frigate, FIG. 6*b* shows a perspective view of the ramp in a fully erected (open) position behind the steering cabin of a frigate, FIG. 7 shows side view of the ramp according to the present invention in the open position, FIG. 8 shows a perspective view of the ramp according to the present invention in the open (fully erected) position, FIG. 9*a* shows side and back views of a frigate installed with a ramp according to the present invention where the case of the ramp is illustrated in a semi-open position, FIG. 9*b* shows side and back views of a frigate installed with a ramp according to the present invention where the case of the ramp is illustrated in closed position, FIG. 10*a* shows a perspective view of a schematic frigate installed with a ramp according to the present invention where the case of the ramp is illustrated in a semi-open position, FIG. 10*b* shows a perspective view of a schematic frigate installed with a ramp according to the present invention where the case of the ramp is illustrated in closed position.

DETAILED DESCRIPTION OF THE INVENTION

Hereinafter, preferred embodiments of the present invention will be described in detail with reference to the accompanying drawings which are given solely for the purpose of exemplifying embodiments according to the present invention.

Foldable ramp (1) according to the present invention comprises a frame (10) adapted to carry one or more canisters (11) from which rockets or missiles are launched. While the embodiment shown in the attached drawings exemplify a four canister holder, it is possible to increase or decrease the number of canisters carried and orientated by the frame member (10). The frame is carried by a rear support member (12) and a front support member (13), both of which are pivotably connected and hence movable with respect to the frame (10) as shown in FIGS. 4*a* to 4*c*. While the embodiment shown in the attached drawings illustrate the rear and front support members (12,13) in the form of two separate legs for each, it is still within the scope of the present invention that the support members (12,13) may be in the form of a single rod, a plate or multiple legs and/or plates as long as they are pivotably connected to the frame (10) and are adapted to fold underside the frame (10) so as to allow switching between a closed (folded) position and an open (tilted or unfolded) position of the frame and hence the canisters (11) hosted thereon. A plate refers to a three dimensional object whose one dimension is considerably smaller than the remaining two dimensions.

The rear and front support members (12,13) are pivotably connected to the launching platform, which might be the deck (21) of a naval surface ship (22) or a sheet (24) intended for hosting the entire ramp (1) integrally as illustrated in FIG. 4*b*. Simple pivotal joints (15) or ball joints may be used to allow the rotary movement of the rear support element (12) and the front support element (13) with respect to the frame (10) as well as the launching platform, e.g. a deck (21) or a sheet (24). Alternatively, pivotal joints may be replaced by partially sliding connections on the frame side or the launching platform side.

A lifting device (14) is attached to the frame (10) to tilt the frame and elevate the tip of the canisters (11) as required for launching missiles or rockets. While the lifting device (14) as shown in the appended drawings is in pivotal communication with the launching platform and the frame member (10), it is not in fact mandatory for the lifting device to establish rotary movement with the frame (10) and the launching platform as any lifting equipment that would be capable of tilting the frame or unfolding the rear and front support elements (12, 13) would satisfy the need for realizing the invention. The lifting device may be in pivotal or alternatively, sliding communication with the launching platform or the frame (10).

The rear and front support elements (12,13) rotate counter clockwise during unfolding movement of the ramp (1), i.e. when the frame (10) is tilted. While both support elements (12,13) are at an angle which is 0° or close to 0° with respect to the launching platform, both angles increase as the ramp (1) starts unfolding. The unfolding movement of the ramp (1) is illustrated in FIGS. 3*a* to 3*c*. The rear support element (12) spans an angle which is less than 180° in the embodiment shown in the attached drawings. Nevertheless, arrangements can be made to alter the starting and ending angles of the supporting elements with respect to the launching platform.

The rear and front support elements (12,13) span a pantographic movement with respect to launching platform while the ramp is opened i.e. during unfolding. The pantographic movement of the support elements (12,13) result in the displacement of the rear ends of the canisters (11) in the horizontal direction as illustrated in FIGS. 3*a* to 3*c*. While the lower rear end of the canister (or canisters) displaces in an amount of w2 in a direction parallel to the launching platform, the upper rear end of the canister(s) displace a further distance w1, amounting to a total of w, i.e. the sum of (w1+w2). When the ramp is totally unfolded, it is ensured that the centerline of any of the one or more launching canister(s) (11) is displaced horizontally in an amount more than w2 and less than w (=w1+w2). This further ensures that aft flame of any of the missiles launched from the ramp (1) is displaced equally towards the rear of the ramp. Whence the ramp is placed on the side of a naval ship (22) as shown in FIGS. 5*a* and 5*b* at a distance equal to or less than w2 towards the farthest side edge of the ship (22), then the aft flame of the missiles are ensured to hit the sea surface instead of parts of the deck (21) or the launching platform.

The counter clock wise rotation of the rear and front support elements (12,13) is accomplished by actuating the lifting device (14). The lifting device may typically be an electric driven motor, a hydraulic or pneumatic driven equipment, or any other equipment that is capable of lifting the ramp along with the armament loaded in the ramp. Once the ramp (1) is fully open as shown in FIGS. 4*c*, 7 and 8, then the ramp becomes ready for the launching operation. Nevertheless, it is advisable to lock the ramp (1) in tilted position in order to avoid extreme forces on the lifting device during launching. The load on the lifting device (14) is unstable with the inevitable movements of the vehicle to which the ramp is mounted as well as the forces applied by the missile (or rocket) when triggered for launch.

The present invention foresees use of a folding locking device comprising locking elements (16,17) incorporating slots. The locking elements (16,17) shown in FIG. 4*c*. have an upper slot (18) and a lower slot (19) through both of which a locking rod (25) can slide to lock the ramp in place in tilted position (see FIGS. 7 and 8). During the unfolding operation, the locking rod (25) is pulled out of at least the lower locking slot (19) after which the upper locking element (16) folds onto lower locking element (17) with gradual reverse action of the lifting device (14).

The rear and front support elements (12,13) rotate clockwise during folding movement of the ramp (1), i.e. when the ramp (1) is closed. To do this, the lifting device (14) is either gradually deactivated or triggered for reverse action for a smooth folding action. Once folding is complete, the ramp (1) is covered by a collapsible case (23). FIGS. 9*a* and 10*a* show the collapsible casing in semi-closed position whereas FIGS. 9*b* and 10*b* show the same in a totally closed position. A purpose of the collapsible case (23) is to hide the ramp (1) and the armament loaded in said ramp visually from outsiders. As mentioned in the background of the invention, this is not only useful under war conditions but also during piece conditions. A second purpose of the collapsible case is to decrease the radar cross section or the radar visibility of the ramp. This might be further enhanced by surface coating of the collapsible case (23) with anti reflection material having relatively small wave reflection features.

It should be noted that the missiles to be launched from the ramp according to the present invention may weigh around 1,000 kg or even more. In the case of a multi canister launcher, such as that four canister (11) holder exemplified in the attached drawings, the total weight the ramp (1) and the armament may become an extremely heavy or unmanageable payload for a relatively small sized naval ship, e.g. a frigate around 30 m. This payload shall be well balanced with the ship (22) before and after launches as well as during loaded and unloaded cruise in order not to jeopardize the dynamic stability of the ship. This is accomplished by adjusting the dimensions of the ramp (1), such as adjusting the lengths of the rear and front support elements (12,13) and/or the relative position of the canisters (11) and coinciding the center of gravity of the launcher with the center of gravity of the ship (22) as shown in FIG. 5*a*. The ramp is assumed to be in closed (or folded) position during cruise and opened to tilted position when the ship (22) is stationary. It is apparent from FIG. 5*b* that the center of gravity of the launcher does no longer coincide with that of the ship and hence the ship is likely to yaw to a certain extent during unfolding and launching operations. Since the ship remains stationary (i.e. motors off) during unfolding and launching operations, the unbalanced stance of the ship (22) is well manageable. When the payload is totally or partially fired from the ship and the ramp folds to its closed position, the center of gravity of the launcher will return to its initial position aligning with the C.G. of the ship, hence removing the source of instability or unbalanced cruise of the ship. Once the ramp is totally in folded position, the collapsible case (23) is closed onto the ramp either manually by the personnel or by drive means that are set to slide or cover the collapsible case (23) on the ramp (1).

The foldable ramp (1) according to the present invention is preferably located right behind the captain's cabin (20) on the deck (21). While this might help to reduce the radar visibility of the ship (22), it also preferable in terms of reducing the aerodynamic drag originating from the presence of the ramp (1) on the deck (21) during high speed cruise. The frigates to which the ramps of the present invention may preferably be installed are high speed frigates typically cruising at more than 50 knots at sea, which makes the aerodynamic drag a very important factor in terms of the speed limits of the ship and its fuel consumption. Therefore, it is believed that foldable ramp (1) as proposed by the present invention is best located right behind the captain's cabin (20) as illustrated in FIGS. 9*a* and 9*b*.

The invention claimed is:

1. A naval surface ship, on deck of which a foldable ramp is mounted, the foldable ramp comprising:

a frame for carrying and orientating one or more canisters for launching rockets or missiles;

at least one lifting device adapted to lift a front end of the frame with respect to a launching platform on the deck;

at least one rear support element pivotably attached to said frame and adapted to pivotably connect to the launching platform to allow rotary movement of said frame with respect to the launching platform;

at least one front support element pivotably attached to said frame and adapted to pivotably connect to the launching platform to allow rotary movement of the frame with respect to the launching platform; and foldable locking elements in pivotal communication to each other and incorporating, respectively, an upper slot and a lower slot through both of which a locking rod slides to lock the ramp in a tilted position;

wherein the foldable ramp is located on one side of the deck such that in an opened position, rear ends of the canisters face outside an edge of the one side of the deck and front ends of the canisters face toward the other side of the deck, and the at least one front support element is longer than the at least one rear support element, wherein the at least one front and rear support elements span a pantographic movement relative to the launching platform when the at least one lifting device lifts the front end of the frame, and wherein the rear ends of the canisters displace a horizontal distance (w=w1+w2) towards the edge of the one side of deck, as the at least one lifting device lifts the front end of the frame, to avoid aft flame of any launched rockets or missiles from hitting the deck.

2. A naval surface ship according to claim 1, wherein an angle spun by the at least one rear support element during unfolding is larger than that of the at least one front support element.

3. A naval surface ship according to claim 1, wherein the at least one lifting device is driven electrically, hydraulically or pneumatically.

4. A naval surface ship according to claim 1, wherein the at least one rear or front support element comprises a plurality of bars.

5. A naval surface ship according to claim 4, wherein the at least one rear or front support element is pivoted relative to the frame or the launching platform by ball bearings, roll bearings or frictional pivot joints.

6. A naval surface ship according to claim 1, wherein the ramp further comprises a collapsible case.

7. A naval surface ship according to claim 6, wherein the collapsible case is coated with anti reflection material.

8. A naval surface ship according to claim 1, wherein the ramp is positioned to coincide a center of gravity of a launcher in a folded mode with a center of gravity of the ship in a longitudinal direction of the ship.

9. A naval surface ship according to claim 1, wherein the foldable ramp is positioned intermediate a cabin and rear end of the ship.

10. A naval surface ship according to claim 8, wherein the center of gravity of the launcher, in the folded mode, substantially corresponds with the center of gravity of the ship in a widthwise direction of the ship.

* * * * *